US008312874B2

(12) United States Patent
Dupont

(10) Patent No.: US 8,312,874 B2
(45) Date of Patent: Nov. 20, 2012

(54) CAMPFIRE SUPPORT UNIT

(76) Inventor: Daniel L. Dupont, Plaquemine, LA (US)

( * ) Notice: Subject to any disclaimer, the term of this patent is extended or adjusted under 35 U.S.C. 154(b) by 410 days.

(21) Appl. No.: 12/493,187

(22) Filed: Jun. 27, 2009

(65) Prior Publication Data

US 2010/0326423 A1 Dec. 30, 2010

(51) Int. Cl.
*F24B 1/193* (2006.01)

(52) U.S. Cl. ..... 126/540; 126/30; 126/29; 126/25 R

(58) Field of Classification Search ..... 126/9 R, 126/25 R, 29, 30, 92 AC, 92 R, 271.3, 540
See application file for complete search history.

(56) References Cited

U.S. PATENT DOCUMENTS

| | | | | | |
|---|---|---|---|---|---|
| 961,975 | A | * | 6/1910 | Long | 126/30 |
| 1,194,131 | A | * | 8/1916 | Brown | 126/29 |
| 2,573,211 | A | * | 10/1951 | Manzler | 126/25 R |
| 2,575,188 | A | * | 11/1951 | Schell | 99/449 |
| 2,592,561 | A | * | 4/1952 | Greenwood | 248/524 |
| 3,109,420 | A | * | 11/1963 | Ott et al. | 126/9 R |
| 3,331,365 | A | * | 7/1967 | Sussan | 126/25 R |
| 4,186,716 | A | * | 2/1980 | Baker et al. | 126/29 |
| 4,362,194 | A | * | 12/1982 | Lawson | 144/193.1 |
| 4,509,650 | A | * | 4/1985 | Wilgosz | 211/60.1 |
| 4,532,910 | A | * | 8/1985 | Longley, Jr. | 126/9 B |
| 4,971,045 | A | * | 11/1990 | Probst | 126/65 |
| 5,024,208 | A | * | 6/1991 | Hottenroth et al. | 126/25 R |
| 5,074,502 | A | * | 12/1991 | Glendinning | 248/164 |
| D390,935 | S | * | 2/1998 | Bosje et al. | D23/332 |
| 5,722,390 | A | | 3/1998 | Hannebaum | |
| 5,842,463 | A | * | 12/1998 | Hall | 126/9 R |
| 5,901,697 | A | * | 5/1999 | Oliver et al. | 126/92 AC |
| 5,915,371 | A | * | 6/1999 | Hering | 126/9 R |
| 6,516,792 | B1 | * | 2/2003 | McDonald | 126/9 R |
| 6,637,713 | B1 | * | 10/2003 | Kleve et al. | 248/440.1 |
| 6,719,250 | B2 | * | 4/2004 | FitzSimons | 248/166 |
| 6,851,419 | B2 | * | 2/2005 | Reiner | 126/9 B |
| 6,918,387 | B2 | * | 7/2005 | Klarich et al. | 126/201 |
| 6,957,649 | B1 | * | 10/2005 | Bourgeois | 126/40 |
| 7,344,122 | B2 | * | 3/2008 | Gasaway et al. | 256/65.11 |
| 8,001,956 | B1 | * | 8/2011 | Bourgeois et al. | 126/40 |
| 2003/0015186 | A1 | * | 1/2003 | McDonald | 126/9 R |
| 2004/0035407 | A1 | * | 2/2004 | Patience | 126/25 A |
| 2005/0189532 | A1 | * | 9/2005 | Gasaway et al. | 256/65.11 |
| 2005/0191121 | A1 | * | 9/2005 | Gasaway et al. | 403/263 |
| 2008/0283031 | A1 | * | 11/2008 | Korab | 126/30 |
| 2010/0038612 | A1 | * | 2/2010 | Hazlett | 256/65.02 |
| 2010/0116262 | A1 | * | 5/2010 | Voges | 126/25 R |
| 2010/0288261 | A1 | * | 11/2010 | Jones | 126/25 R |

* cited by examiner

*Primary Examiner* — Steven B McAllister
*Assistant Examiner* — Desmond Peyton
(74) *Attorney, Agent, or Firm* — Reginald F. Roberts, Jr.

(57) ABSTRACT

A campfire support unit for burning firewood. The unit has a metal frame that includes a metal support ring with metal tabs and support legs. The frame is made and arranged to support wood for a wood fire in a near-vertical ring position around a central core which contains wood supported in a near-vertical position. An internal core fire is started, using wood placed inside the metal ring. Then wood is leaned against the outer rim of the metal ring. The tabs support the wood leaned against the outer rim, preventing it from falling before, during, and after the outer wood is ignited by the internal core fire.

1 Claim, 6 Drawing Sheets

CAMPFIRE SUPPORT UNIT

BACKGROUND OF THE INVENTION

The present invention relates to campfires. More particularly, the invention relates to a campfire support unit for burning firewood.

U.S. Pat. No. 5,722,390 to Hannebaum discloses a fireplace wood holder which holds firewood in a vertical position, so that the firewood's fibers and water-conducting channels are oriented substantially up and down, to allow more nearly complete burning and combustion. However, the fireplace holder provides only for wood that is enclosed by the holder. There is no mechanism for utilizing the holder to support firewood external of the holder. Although the applicant was, at the time he invented his campfire unit, not aware of the patent to Hannebaum, the present invention provides such a mechanism.

SUMMARY OF THE INVENTION

In general, the present invention provides a campfire support unit for burning firewood. The campfire support unit comprises (a) an annular member constructed and arranged to confine enclosed firewood, and to laterally support the enclosed firewood; (b) a plurality of lateral members extending outward from perimeter of the annular member, the lateral members being spaced apart, and being constructed and arranged to laterally support firewood disposed outside the perimeter of the annular member; and (c) support means for the annular member.

DETAILED DESCRIPTION OF THE DISCLOSED EMBODIMENTS

Figure 1:
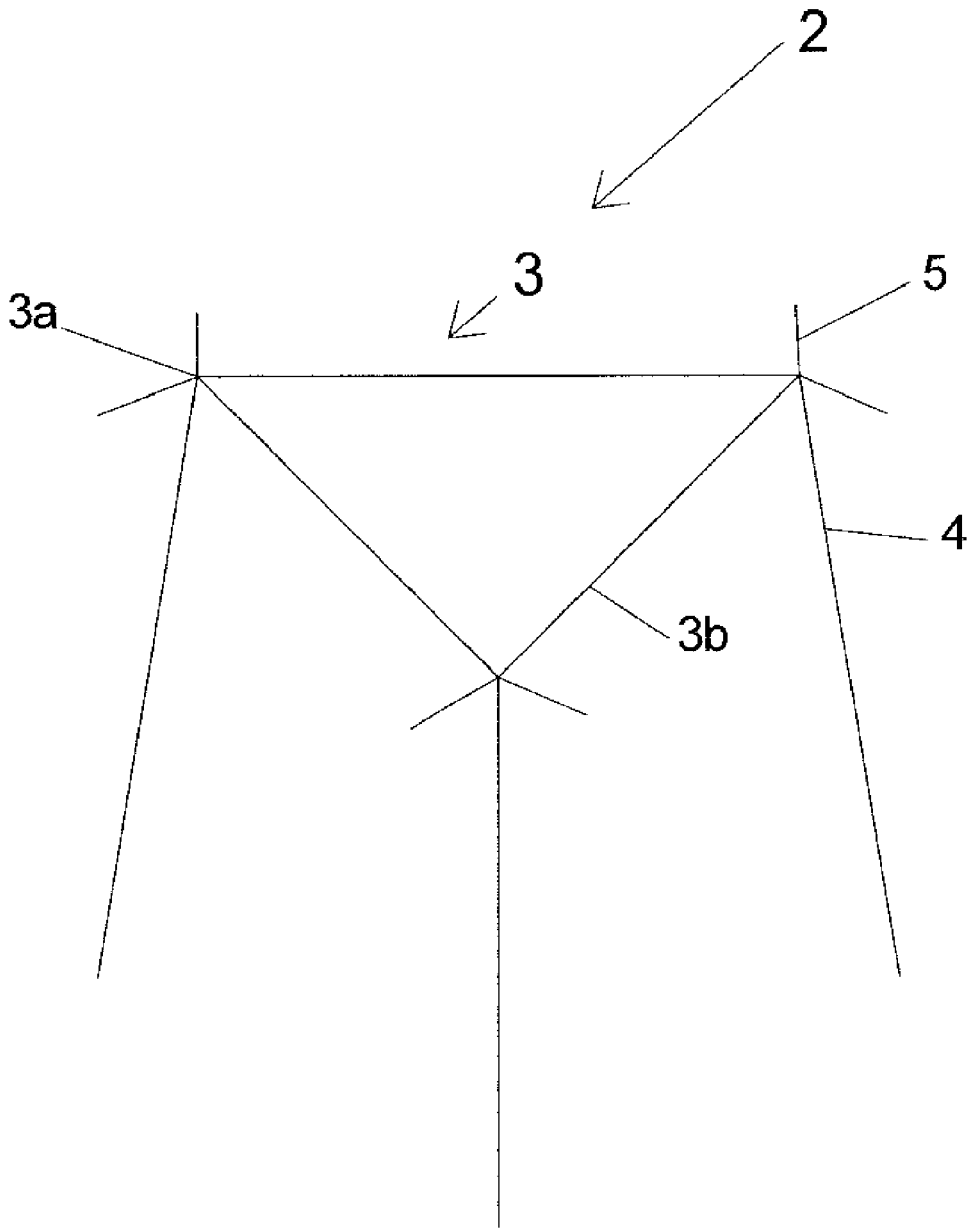
FIG. 1 is an isometric view of a first embodiment of a campfire support unit, made in accordance with the principles of the present invention.

More specifically, reference is made to FIG. 1, in which is shown a first embodiment of a campfire support unit for burning firewood in a fire pit, fire ring, or on open ground, made in accordance with the principles of the present invention, and generally designated by the numeral 2.

The campfire support unit 2 comprises a rigid triangular annular member 3 constructed and arranged to confine and enclose firewood (not shown). The rigid triangular annular member 3 is supported by a plurality of legs 4, each leg 4 being connected to each apex 3*a* of the rigid triangular annular member 3. A pair of rigid tabs 5 extends outward from each apex of the perimeter 3*b* of the rigid triangular annular member 3. The tabs 5 are constructed and arranged to provide lateral support for firewood disposed outside the perimeter 3*b* of the rigid triangular annular member 3

The campfire support unit 2 is constructed and arranged to support wood for a wood fire in a near-vertical ring orientation around a central core of wood supported in a near-vertical orientation. The tabs 5 keep the near-vertical logs of the outer ring from falling during the fire-burning operation of the campfire support unit 2.

Any fire-resistant metal such as steel, or any non-metallic fire-resistant material capable of providing the necessary support for the firewood, could be used to fabricate the campfire support unit 2.

For operation, the campfire support unit 2 is placed in a location safe for burning firewood. A core fire is started with wood disposed within the rigid triangular annular member 3. Small, then medium-sized fuel wood is added to the core as the fire grows. Once the core fire is established, wood is added to and supported by the perimeter 3*b* and tabs 5. The core fire ignites the inside edges of the external wood ring. Once these inside edges are burning, larger logs can be added to the core. These larger logs will quickly reach ignition temperature and emit heavy flames. The vertical wood ring creates a draft that draws smoke and air into the core flame. This vertical draft generates more heat than a stacked fire, while also providing more flames from the wood. As the flames subside, more wood can be added to the core to generate continued flames from the fire. As the wood in the vertical ring burns down to coals, more vertical ring wood can be added to continue the process as along as desired.

Because of the controlled, substantially vertical configuration of the wood and the high core temperature during operation, the campfire support unit 2 burns wet or fresh-cut wood with less smoke than stacked fires. The campfire support unit 2 also develops a bed of coals more quickly than traditional campfire methods, thereby providing less time to start a cooking fire.

Reference is now made to FIGS. 2-6, which illustrate other embodiments of the campfire support unit.

Figure 2:
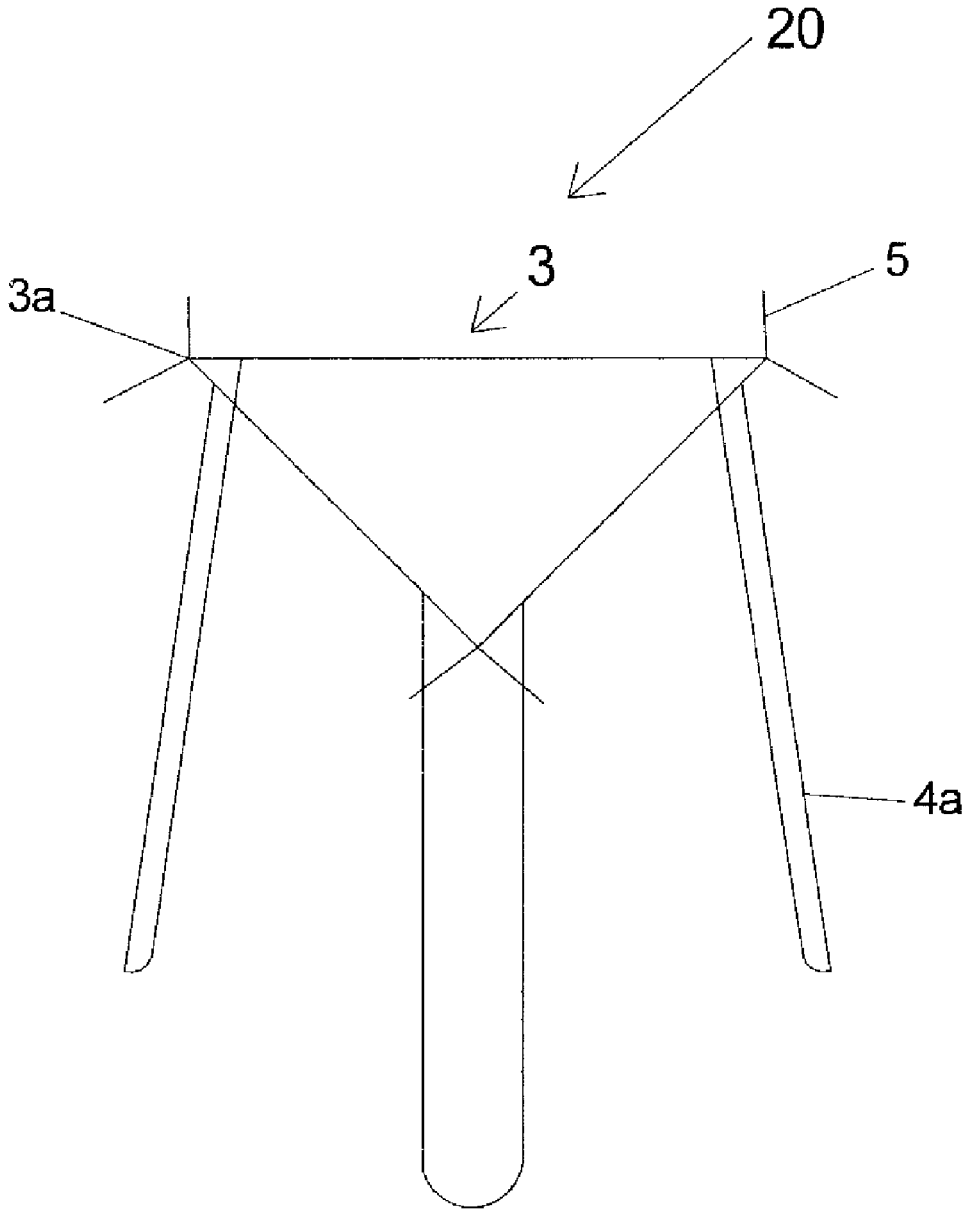
FIGS. 2-6 are isometric views of second, third, fourth, fifth, and sixth embodiments of the invention.

FIG. 2 shows a second embodiment 20, in which the legs 4 of the first embodiment 2 are replaced by legs 4*a*.

Figure 3:
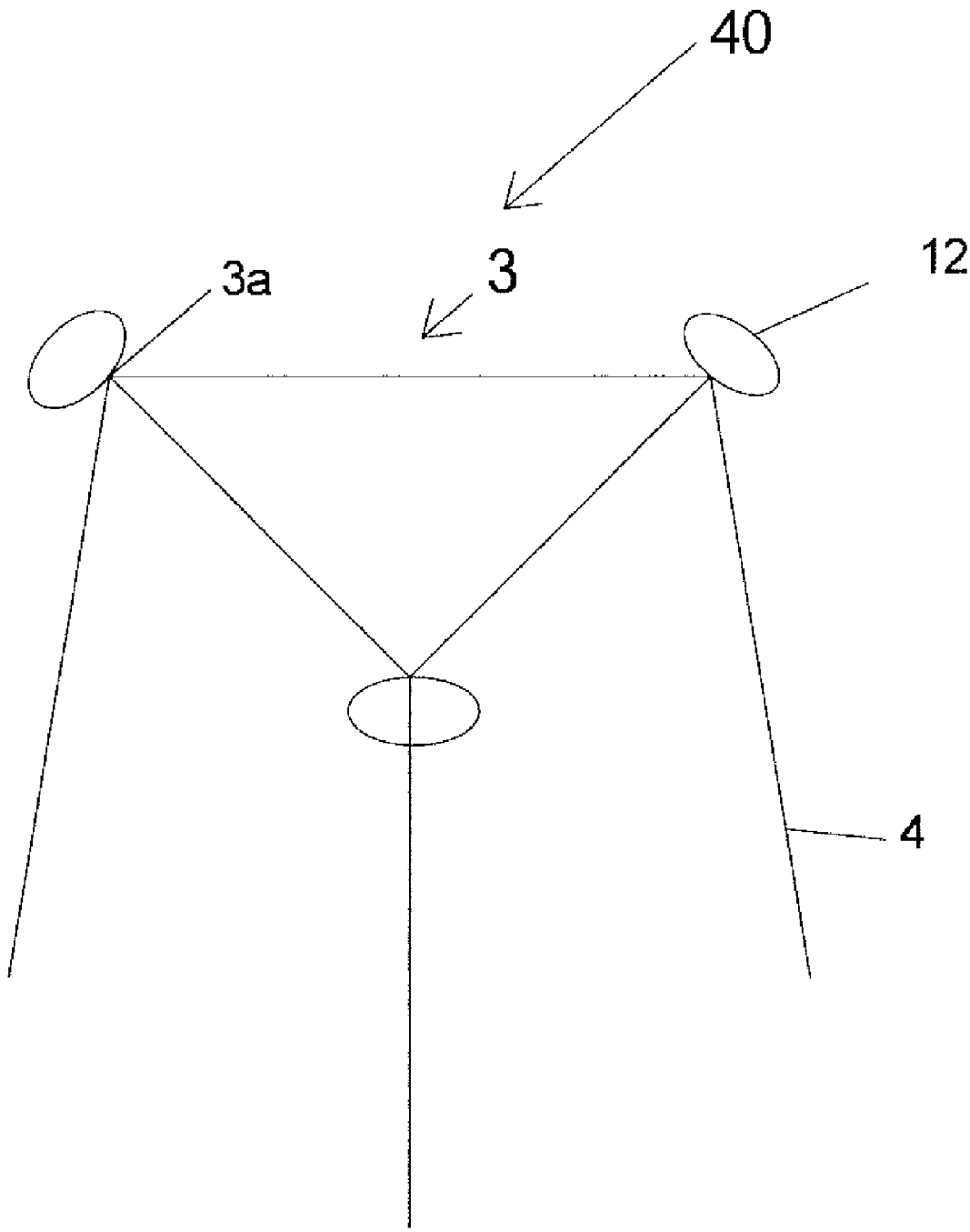

FIG. 3 shows a third embodiment 40, in which some of the tabs 5 of the first embodiment 20 are replaced by tabs 12, and the remaining tabs 5 are omitted.

Figure 4:
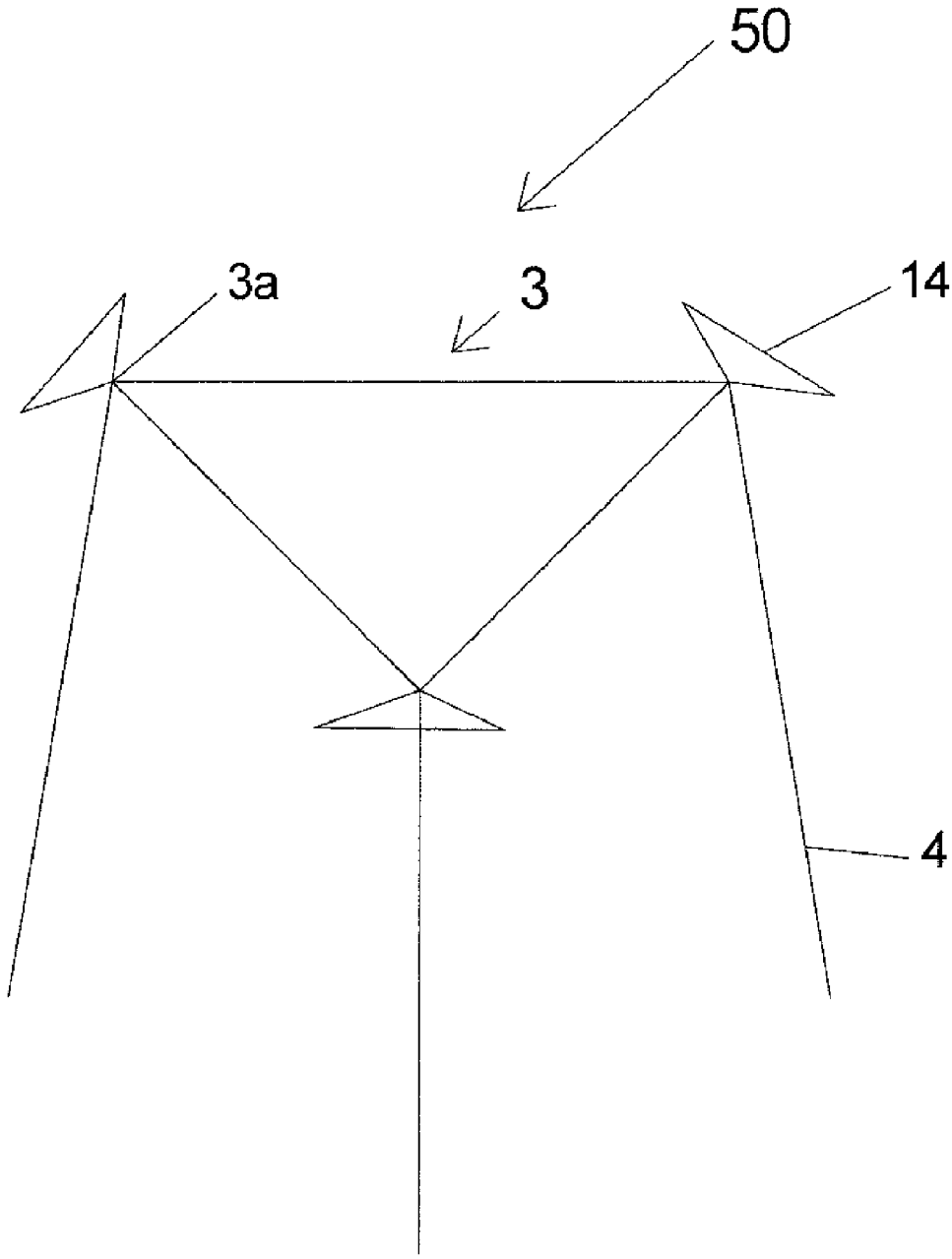

FIG. 4 shows a fourth embodiment 50, in which the tabs 12 of the third embodiment 40 are replaced by tabs 14.

Figure 5:
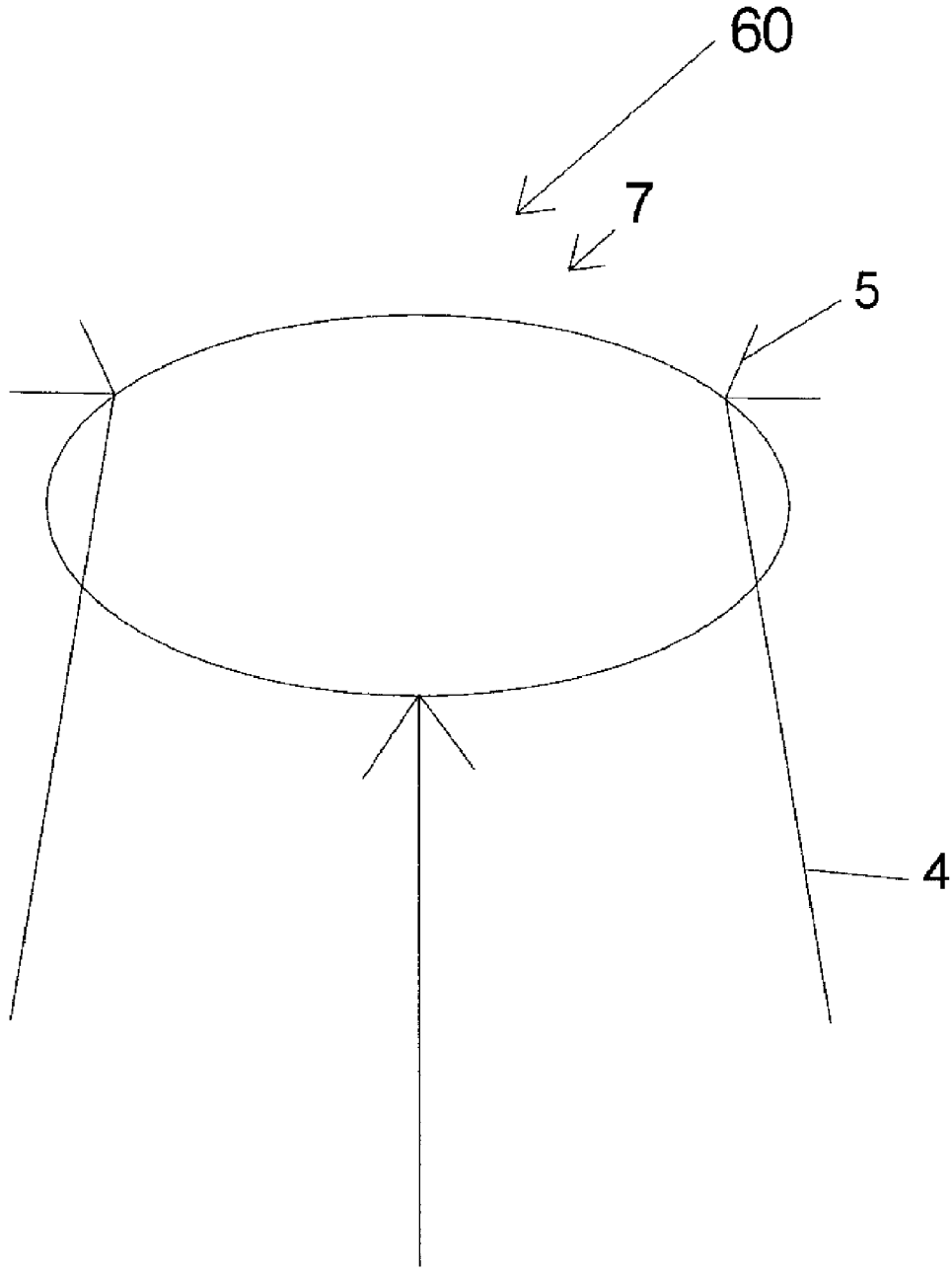

FIG. 5 shows a fifth embodiment 60, in which the rigid annular triangular member 3 of the first embodiment 2 is replaced by a rigid annular circular member 7, with each group of three tabs 5 being substantially equally spaced apart from one another at approximately one-hundred-and-twenty degree intervals.

Figure 6:
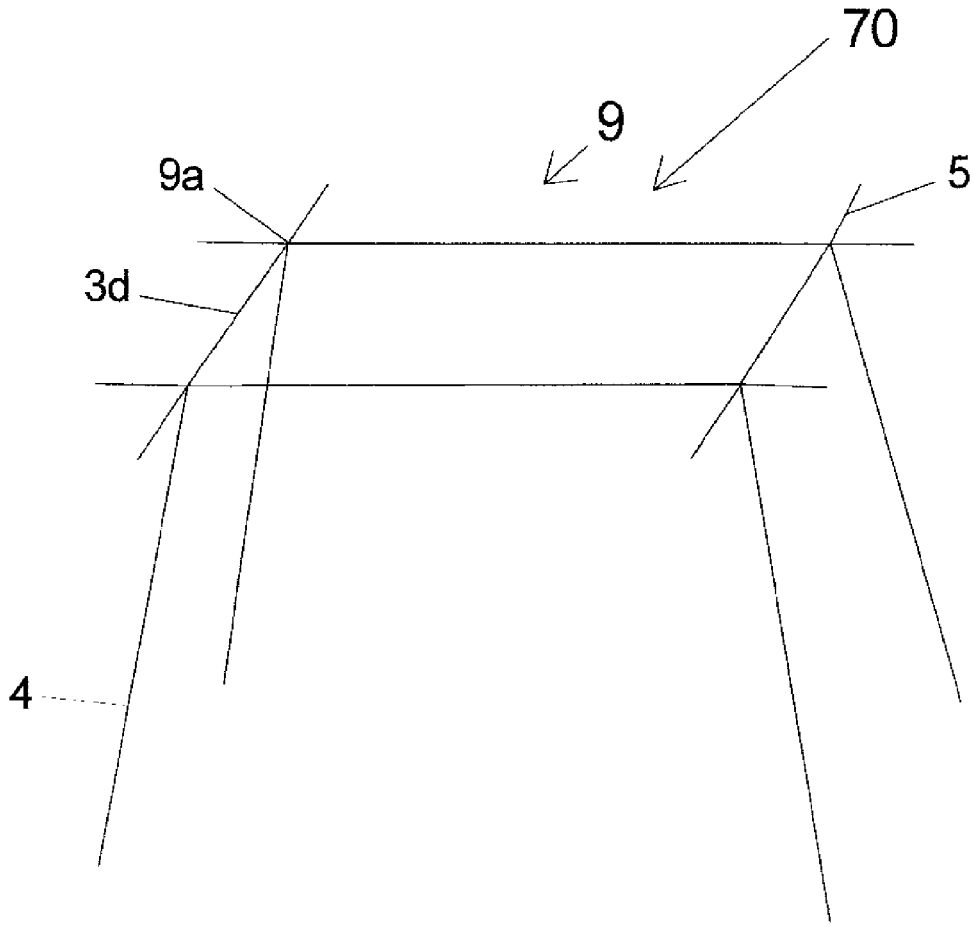

FIG. 6 shows a sixth embodiment 70, in which a rigid annular square member 9 replaces the rigid annular triangular member 3 of the first embodiment 2, and a pair of tabs 5 is disposed at each corner 9*a* of the rigid annular square member 9.

It will be apparent too those skilled in the art that, besides those disclosed herein, many other geometric shapes of the campfire unit are possible and feasible. Examples include a triangle that is not equilateral, and a rectangle that is not square.

While certain details and embodiments have been described to illustrate the principles of the present invention, it will be apparent to those skilled in the art that many modifications are possible within the scope of the claimed invention.

I claim:

1. A campfire support unit, comprising:

(a) a triangular annular member having first, second, and third apexes, the triangular member being constructed and arranged to confine enclosed firewood, and to laterally support the enclosed firewood;

(b) support means for the triangular annular member, the support means comprising first, second, and third elongated members;

(c) first and second lateral members extending outward from the first apex of the triangular annular member;

(d) third and fourth lateral members extending outward from the second apex of the triangular annular member; and (e) fifth and sixth lateral members extending outward from the third apex of the triangular annular member;

the lateral members being constructed and arranged to laterally support firewood disposed outside a perimeter of the triangular annular member; the first, second and third elongated members having top and bottom ends, only the top ends of the elongated members being connected to the triangular member, and only the top ends of the elongated members being connected to any other member.

* * * * *